US005339592A

United States Patent [19]

Schmid

[11] Patent Number: 5,339,592

[45] Date of Patent: Aug. 23, 1994

[54] INSULATED BUILDING BLOCKS AND COMPOSITE WALLS HAVING STACKABLE HALF-BOND SYMMETRY

[76] Inventor: Donald T. Schmid, 10835 Park Ave., Clarence, N.Y. 14031-2242

[21] Appl. No.: 930,846

[22] Filed: Aug. 14, 1992

[51] Int. Cl.[5] ..... E04C 1/00

[52] U.S. Cl. ..... 52/606; 52/309.12; 52/405.4

[58] Field of Search ..... 52/606 OR, 309.12, 405, 52/612, 570, 309.11

[56] References Cited

U.S. PATENT DOCUMENTS

| | | | |
|---|---|---|---|
| 1,241,144 | 9/1917 | Parsons . | |
| 1,422,579 | 7/1922 | Kent . | |
| 1,668,590 | 5/1928 | Hilfreich | 52/405 |
| 2,887,869 | 5/1959 | McKay | 52/439 |
| 4,004,385 | 1/1977 | Kosuge | 52/439 |
| 4,167,840 | 9/1979 | Ivany | 52/439 |
| 4,185,434 | 1/1980 | Jones | 52/405 |
| 4,188,760 | 2/1980 | Frost | 52/405 |
| 4,483,115 | 11/1984 | Schoenfelder | 52/309.12 |
| 4,551,959 | 11/1985 | Schmid | 52/309.12 |
| 4,614,071 | 9/1986 | Sams et al. | 52/309.12 |
| 4,854,097 | 8/1989 | Haener | 52/309.11 |
| 4,856,248 | 8/1989 | Larson et al. | 52/309.12 |
| 4,986,049 | 1/1991 | Kennedy et al. | 52/309.12 |
| 5,024,035 | 6/1991 | Hanson et al. | 52/309.12 |
| 5,066,440 | 11/1991 | Kennedy et al. | 52/309.12 |
| 5,209,037 | 5/1993 | Kennedy et al. | 52/309.12 |

*Primary Examiner*—Carl D. Friedman
*Assistant Examiner*—Wynn E. Wood
*Attorney, Agent, or Firm*—Hodgson, Russ, Andrews, Woods & Goodyear

[57] ABSTRACT

An insulated building block having stackable half-bond symmetry. The block has a pair of block parts the inner surfaces of which are serpentine-shaped defined by overlapping projections alternately from the block parts. Insulation is sandwiched between the block parts. The projections have enlarged end portions for interlocking the insulation to the block parts. The portion of the serpentine pattern in one of the block halves, defined by a plane parallel to the end walls and midway therebetween, is a repeat of the portion of the serpentine pattern in the other of the block halves such that the blocks are stackable in a staggered half bond relation with alignment of the insulation in the stacked block halves. At least two pins on different axes each extending longitudinally of the block into at least one projection of each block part. For bonding the insulation to the block parts, bonding material is injected into at least one cavity in the insulation in contact with both the insulation and at least one of the block parts. A composite wall comprises such building block parts stacked in half-bond symmetry, a poured concrete sheet, and insulation material having the serpentine pattern between the block parts and the concrete sheet.

27 Claims, 3 Drawing Sheets

Fig. 4.
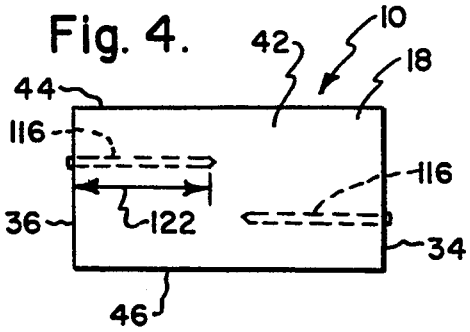
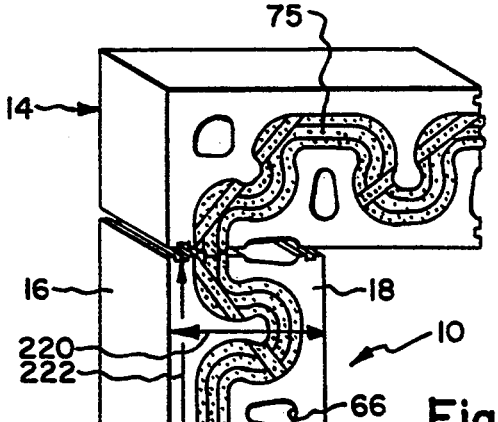
Fig. 1.
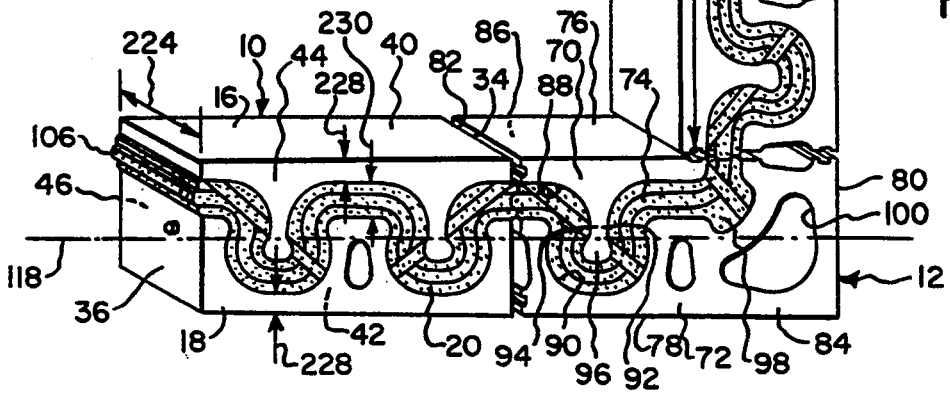
Fig. 2.
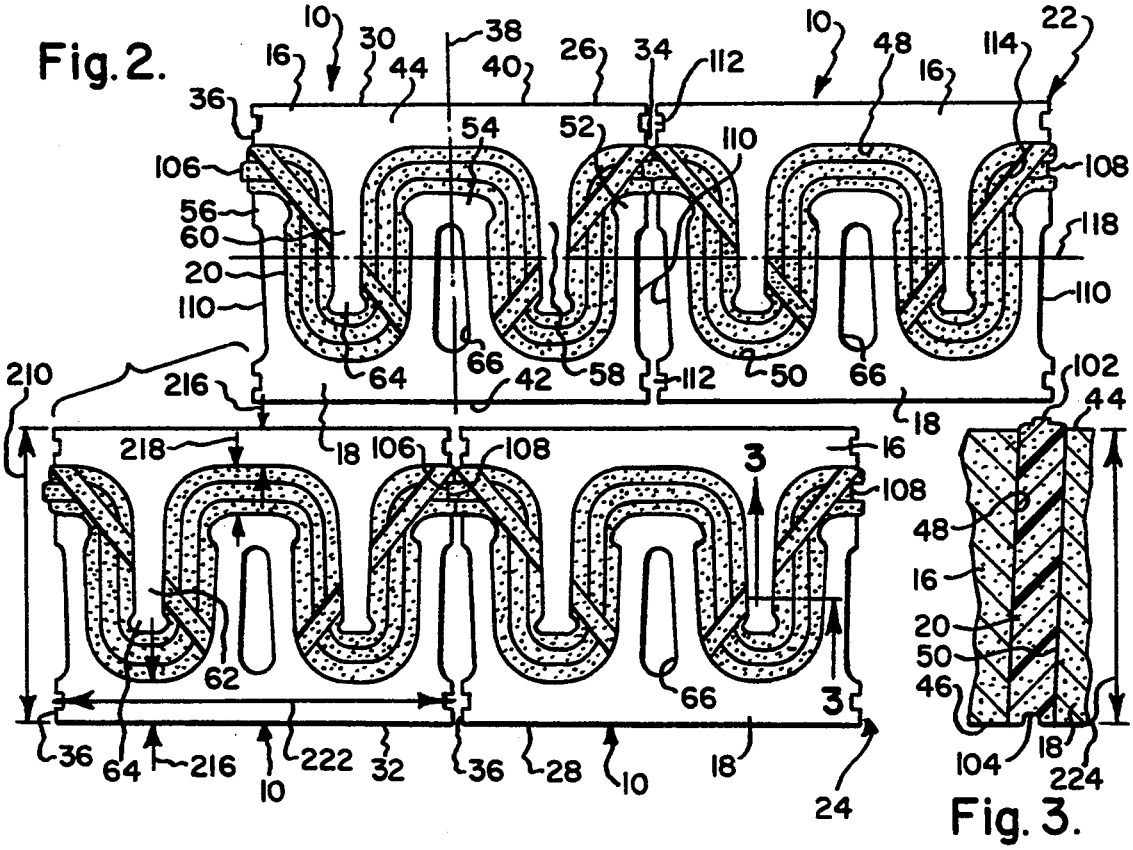
Fig. 3.

Fig. 5.
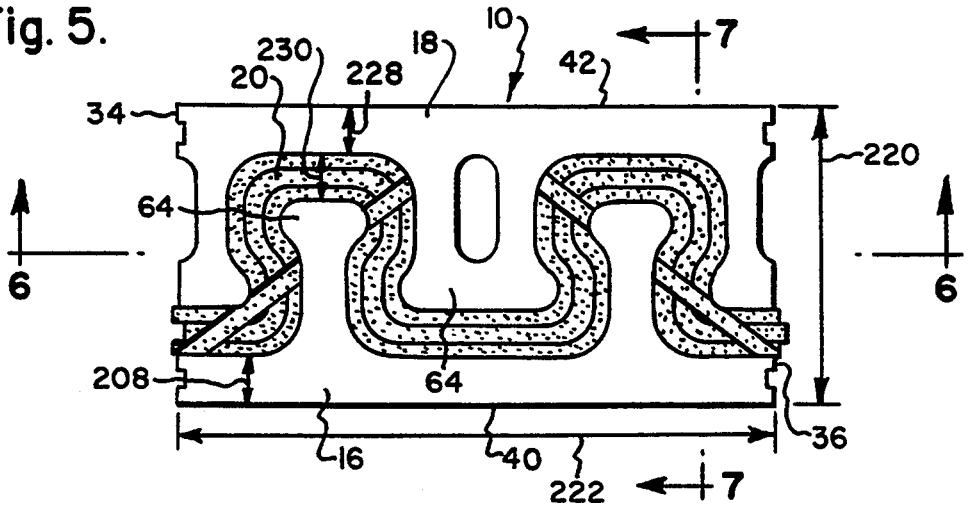
Fig. 6.
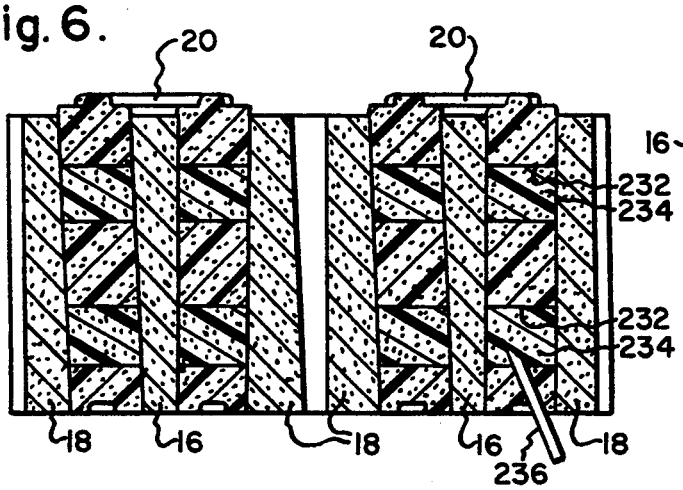
Fig. 7.
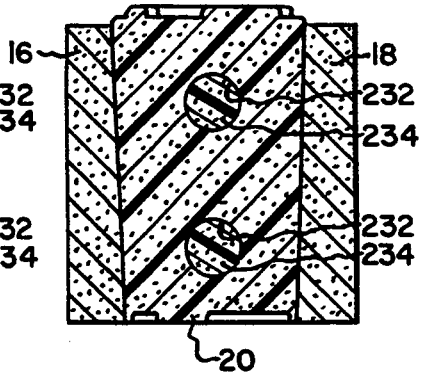
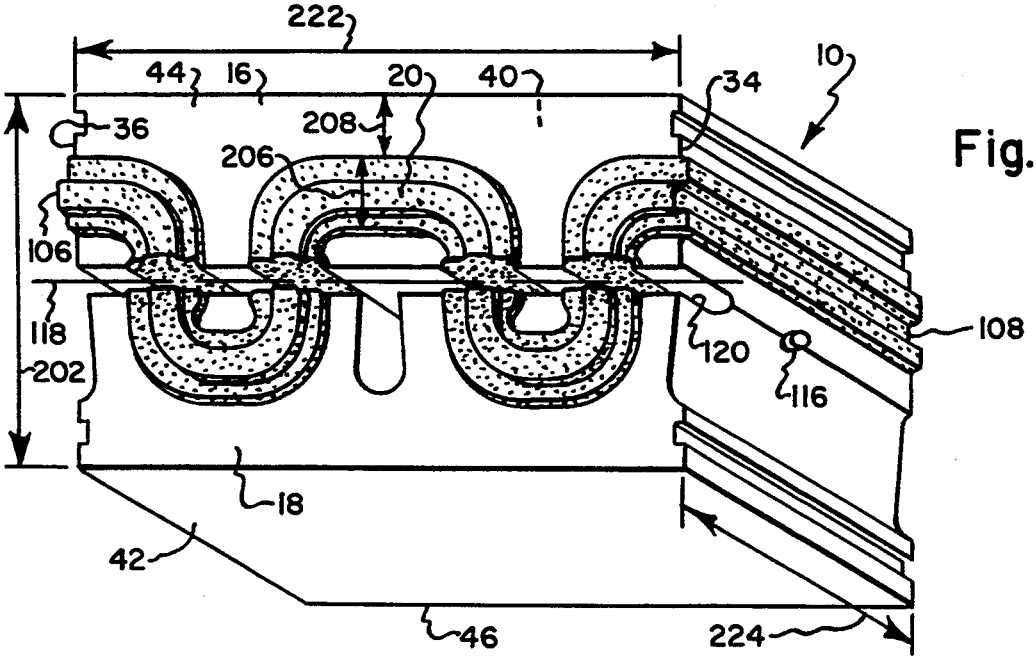
Fig. 8.

INSULATED BUILDING BLOCKS AND COMPOSITE WALLS HAVING STACKABLE HALF-BOND SYMMETRY

The present invention relates generally to insulated building blocks and composite wall structures.

In order to minimize the thermal conductivity between two sidewalls of a building block, the block can be constructed with a quantity of insulating material positioned between its two sidewalls, as described in my U.S. Pat. No. 4,551,959, the disclosure of which is incorporated herein by reference. Such a block has two parts which are spaced from one another so as to define, as viewed in cross-section, a continuous serpentine-shaped gap therebetween. A portion of similarly serpentine-shaped insulating material is disposed between the two parts. The insulating portion is exposed at such locations around the block that, when the block is used in selected locations in a wall construction, the insulating portion is hidden from view by other blocks in the wall which are positioned adjacent to the block. The serpentine shape is provided by a plurality of alternate projections on the block parts which overlap each other. The ends of the projections are enlarged so as to mesh or be interlocked with the insulation portion for securely interconnecting the block parts together. U.S. Pat. Nos. 4,986,049 and 4,185,434, which are also incorporated herein by reference, also disclose insulated building block constructions.

Building blocks are typically laid in half-bond relation i.e., each block in a course is laid so that half of the block overlies half of the building block in the course below and the other half thereof overlies half of the adjacent building block in the course below. The serpentine shapes of the insulated material in the blocks shown and described in the '959 and '049 patents do not allow alignment of the insulating material between blocks during half-bond stacking thereof. Such half-bond alignment, resulting in alignment of the block component parts, would be desirable for increased lateral stability, i.e., when bedded properly, the blocks may be said to present as a veritable two-wythe wall that is dovetailed or interlocked together in a compressed single width.

Half-bond symmetry may be obtained with the blocks of the '434 patent by reversing alternate courses of blocks, i.e., arranging the blocks in alternate courses so that the end walls thereof face in opposite directions from the corresponding end walls in the blocks in the course below. However, such blocks do not allow the construction of half blocks for use in alternate courses at door and window facings and other wall ends which have independent interlocking between the block parts thereof so that the half block integrity is maintained.

It is accordingly an object of the present invention to provide insulated building blocks and half blocks which are stackable to provide half-bond alignment of the insulating material and of the component parts.

It is a further object of the present invention to provide such a building block which has uniform insulation thickness.

It is another object of the present invention to effect mating of the insulation between blocks for enhanced insulating effectiveness.

It is another object of the present invention to provide more secure interlocking between the block parts for increased block integrity.

It is yet another object of the present invention to provide increased thickness of the insulating material for increased insulating capability.

It is another object of the present invention to provide such blocks wherein there is self-contained protective encapsulation of insulation material in the walls built therewith.

It is yet another object of the present invention to provide a composite wall formed of an interlocked combination of a plurality of courses of stacked blocks, a poured concrete sheet, and insulating material between the blocks and the concrete sheet.

It is still another object of the present invention to provide good insulating capability to such a composite wall.

It is yet another object of the present invention to provide self-contained protective encapsulation of the insulating material in such a composite wall.

In accordance with the present invention a block comprising two block parts with insulating material in a serpentine pattern between the block parts provided by projections alternately over the block lengths from the facing inner surfaces of the block parts is characterized by the portion of the serpentine pattern in one of the block halves being substantially a repeat of the portion of the serpentine pattern in the other of the block halves such that two of the block are stackable in a staggered half-bond relation with alignment between the serpentine-patterned portions in the stacked block halves. The projections have enlarged end portions for interlocking the insulation portion to the block parts. In order that each block half may have independently interlocking integrity for use in alternate courses at door and window facings and other wall ends, one of the block parts has a projection centrally of the length thereof and at least one projection in each of the block halves, and the other block part has at least one projection in each of the block halves.

In order to allow reduction in the sizes of enlarged ends of the projections so that a greater thickness of insulating material may be achieved for greater insulating value, in accordance with the present invention pin means are provided along at least two axes longitudinally of the block such that each pin is inserted in at least one portion of each block part thus providing a more secure interlock between the block parts.

Further in accordance with the present invention a plurality of courses of blocks are stacked alongside a subsequently poured concrete sheet and separated therefrom but interlocked therewith by insulating material which has a serpentine pattern wherein the blocks are stacked in a staggered half-bond relation with alignment between the serpentine-patterned portions in respectively stacked blocks whereby a single piece of insulation material may be fitted to blocks in two or more courses for a more secure composite wall arrangement.

The above and other objects, features, and advantages of the present invention will be apparent in the following detailed description of the preferred embodiments thereof when read in conjunction with the accompanying drawings wherein like reference numerals denote the same or similar parts throughout the several views.

BRIEF DESCRIPTION OF THE DRAWINGS

FIG. 1 is a perspective view of part of a course of blocks which embody the present invention.

FIG. 2 is a plan view of an alternative embodiment of the blocks illustrated in portions of two courses arranged for the stacking of blocks in one course over the blocks in the other course in a half-bond relation.

FIG. 3 is a section view of a portion of one of the blocks of FIG. 2, taken along lines 3—3 thereof.

FIG. 4 is a side view of one of the blocks of FIG. 1 showing a two-axis pin arrangement therefor.

FIG. 5 is a plan view of an alternative block embodiment.

FIG. 6 is a sectional view of the block of FIG. 5 taken along lines 6—6 thereof and illustrating a process for bonding the insulation material to the block parts.

FIG. 7 is a sectional view similar to that of FIG. 6 taken along lines 7—7 of FIG. 5.

FIG. 8 is a perspective view of an alternative embodiment of the blocks illustrating a bond beam slot.

DETAILED DESCRIPTION OF THE PREFERRED EMBODIMENTS

Figure 9:
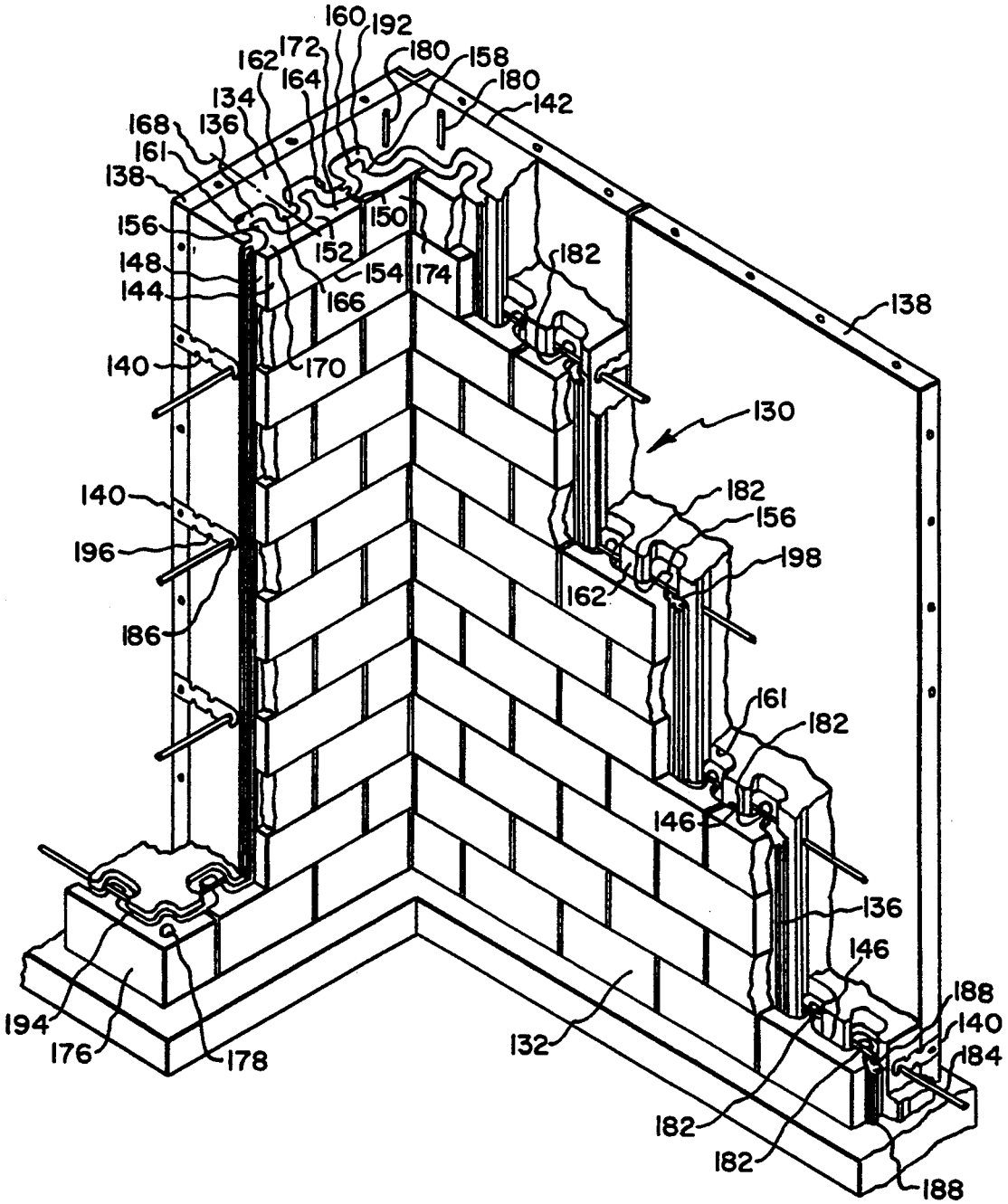
FIG. 9 is a perspective view of a composite wall portion, illustrating a concrete sheet therefor being poured, which embodies the present invention.

Referring to FIGS. 1 to 8, there are shown at 10 insulated building blocks in four different embodiments in FIGS. 1, 2, 5, and 8 respectively, the differences in which will be explained in greater detail hereinafter. Illustrated at 12 and 14 in FIG. 1 are outside corner and inside corner insulated building blocks respectively. Where applicable, a discussion of building blocks 10 will also apply to blocks 12 and 14.

The building block 10 is comprised of two outer supportive parts 16 and 18 which are isolated from one another by a portion of insulating material 20, and the supporting parts and insulating portion cooperate with one another in an interlocking arrangement hereinafter described so that the structural integrity of the block 10 as a unit is sound.

The blocks 10, 12, and 14 are adapted for use in a wall comprised of like blocks in which it is desired that the thermal conductivity between opposite sides of the wall be low. Thus, FIG. 1 illustrates a portion of a course of the blocks, and FIG. 2 illustrates portions of two courses 22 and 24 respectively of blocks with course 22 intended to be above course 24 but illustrated as offset therefrom for purposes of clarity. Courses 22 and 24 are shown aligned for a half-bond relation so that half of one block, which half is illustrated at 26, overlies half of a block below, which half is illustrated at 28, and the other half 30 of the same block overlies half 32 of an adjacent block in the lower course. The halves of a block are defined by a plane, illustrated at 38, parallel to the block ends 34 and 36 and midway therebetween. Thus, the blocks in course 22 would be laid so that the plane 38 in a block thereof would pass between the ends of two adjacent blocks in the course 24 below. A half-bond relation is similarly illustrated for the courses of blocks in the wall of FIG. 9.

Although the block 10 is particularly well-suited for use in a load-bearing wall for reasons hereinafter discussed, it will be understood that an embodiment of a block in accordance with the present invention can be used in a nonload-bearing wall such as a nonload-bearing building facade. Accordingly, the term "block", as used in the context of this specification and the claims, is intended to include modular panels.

In addition to the opposite end walls 34 and 36, which are generally planar and parallel to each other, the block 10 has two opposite planar sidewalls 40 and 42, which are also generally parallel to each other, a planar top wall 44 and a planar bottom wall 46, which are also generally parallel to each other. The sidewalls 40 and 42 are substantially perpendicular to the top and bottom walls 44 and 46 respectively and the end walls 34 and 36, and the top and bottom walls 44 and 46 respectively are substantially perpendicular to the end walls 34 and 36. When resting upon its bottom 46, the block parts 16 and 18 are vertically disposed and horizontally spaced. The block parts 16 and 18 are comprised of a suitable material such as, for example, any cementitious material or baked clay adapted to support a compressive load. With respect to block 10, one block part 16 defines one sidewall 40, and the other block part 18 defines the other sidewall 42. With respect to blocks 12 and 14, one of the block parts may define one sidewall and a portion of the other sidewall, as will be discussed in greater detail hereinafter.

The insulating portion 20 is comprised of a quantity of insulating material which can be any of a number of suitable materials such as urea or phenol formaldehyde, polystyrene, phenolic resins, or polyurethane foam. As shown in FIGS. 2 and 3, the insulation portion 20 extends slightly beyond the end walls and the top wall to effect mating of adjacent insulating portions with the thickness of the mortar between blocks taken into account. The insulation portion 20 is flush with the bottom wall 46, as shown in FIG. 3, for ease of handling in that the block may thereby be easily laid down flat on a surface. The insulating portion 20 may terminate at one edge in a rib or tongue 102, illustrated at the top wall 44 in FIG. 3, and terminate at the other edge in a mating groove 104, illustrated at the bottom wall 46. The tongue 102 is preferably provided in the upper edge of the insulation portion 20 in order that mortar will not accidentally be placed in the groove 104 as it is applied to the upper wall of the block. Similarly, the insulating portion 20 has at one end a rib or tongue 106, illustrated at end wall 36, to mate with a groove 108 at the other end, illustrated at end wall 34, so as to allow the mating of insulating portions 20 of adjacent blocks. The tongue-and-groove configuration for the insulating portions 20 allows a tight fit therebetween to interfere with convection currents so as to provide enhanced insulation capability.

In order that the block parts 16 and 18 may be assembled quickly to form the block 10, the insulating material may preferably be a type of premolded insulation such as, for example, expanded polystyrene. If desired, foam-in-place insulation such as polyurethane foam or any other suitable insulation may be used. To assemble the block with premolded insulation, the block parts are initially arranged in their desired spaced relation relative to one another and subsequently held in such relation while the insulating material is inserted into the space between the block parts.

The block parts 16 and 18 have, opposite their respective sidewalls 40 and 42, surfaces 48 and 50 respectively which engage the insulation portion 20. These surfaces 48 and 50 extend over the height of the block 10 and are inwardly (between the sidewalls 40 and 42) of the assembled block. The inner surfaces 48 and 50 are defined in part by a plurality of block part projections which alternate over the block length between projections of surface 48 and projections of surface 50. Thus, block part 18 is shown to have three such projections: one, illustrated at 54, lying along the center plane 38; and two, illustrated at 52 and 56, lying at the respective block ends to define partially the end walls 34 and 36 respectively. Projection 54 is a double-width projection so that it may overlie an end wall projection of one block and an end wall projection of an adjacent block on which the block is stacked in half-bond symmetry, as can be seen in FIG. 2 by having one of the blocks in course 22 overlie a pair of adjacent blocks in course 24 in half-bond relation. Block part 16 has two projections: one, illustrated at 58, lying between and overlapping width-wise projections 52 and 54, and the other, illustrated at 60, lying between and overlapping width-wise projections 54 and 56. The inner surfaces 48 and 50 are spaced from each other generally uniformly over the length thereof thereby defining a serpentine pattern for insertion of the insulating portion 20 which is accordingly serpentine-shaped and of generally uniform thickness over the length and height thereof.

Each of the projections is shaped to comprise a neck portion 62 and an enlarged bulbous portion 64 at the outer end thereof, the enlarged portions 64 serving to interlock the respective block parts 16 and 18 with the insulating portion 20 to help hold the block parts 16 and 18 and insulating portion 20 together to achieve structural integrity of the block.

Blocks 12 and 14 are particularly well-suited for use at a corner of a wall construction. The block 12 includes a pair of supportive parts 70 and 72 and an insulating portion 74. The block 12 includes a pair of generally planar parallel sidewalls 76 and 78, a pair of generally planar parallel end walls 80 and 82, and generally planar parallel top and bottom walls 84 and 86 respectively. Unlike block 10, in block 12 the end wall 80 as well as the sidewalls 76 and 78 are exposed to view in a wall structure built with the blocks since it is a corner block. Thus, unlike block 10, in block 12 the insulation portion 74 should not exit at end wall 80 but should instead exit through sidewall 76 at a location, as shown in FIG. 1, to mate with the insulation portion 20 in the adjacent block 10, which is oriented at 90 degrees relative thereto. Thus, insulation portion 74 extends between the end wall 82 and the sidewall 76 in a suitable serpentine pattern. The block parts 70 and 72 have inner surfaces 88 and 90 respectively. Surface 88 of block part 70 has one projection 92 with a neck 94 and an enlarged bulbous end portion 96, and inner surface 90 of block part 72 is generally uniformly spaced from surface 88 with the exception of increased spacing at 98 just before the insulation portion 74 terminates at the sidewall 76. Thus, block part 70 defines a portion of end wall 82 and a portion of sidewall 76 while the larger block part 72 defines a portion of end wall 82, all of sidewall 78, all of end wall 80, and a portion of sidewall 76. One or more weight-reducing holes 100, also providing hand-holds, may also be provided through the block height. Block 14, also being a corner block, is constructed using similar principles as described for block 12 with each of the block parts thereof having suitable projections to provide a serpentine-patterned insulating portion 75 hidden from view in a finished wall constructed with the blocks.

Blocks 10 may, for example, have a length, illustrated at 222, of perhaps about 16 inches and a height, illustrated at 224, of perhaps about 8 inches, these being nominal dimensions to allow about $\frac{3}{8}$ inch for mortar. Thus, the actual dimensions would be about $\frac{3}{8}$ inch less. It should of course be understood that blocks having other dimensions are meant to come within the scope of the present invention. Three different block widths are illustrated in FIGS. 1 to 8.

The blocks illustrated in FIG. 1 may have a nominal width, illustrated at 220, of perhaps about 8 inches. The distance, illustrated at 228, between the insulation and a side of the block is preferably at least about $1\frac{1}{4}$ inches, as required by block standards, i.e., perhaps about $1\frac{1}{4}$ inches, and the insulation thickness, illustrated at 230, may be perhaps about $1\frac{1}{2}$ inches. Account should of course be taken for some variance between the top and bottom walls in the dimensions of blocks 10 in FIGS. 1 to 8 due to taper of the inner surfaces 48 and 50, as described hereinafter. Although the configuration is different, the sizes for the blocks shown in FIG. 5 may be the same as described above for the blocks of FIG. 1.

The blocks shown in FIG. 2 may have a nominal width, illustrated at 210, of perhaps about 12 inches. The distances, illustrated at 216, between the insulation material and a side of the block is preferably at least about $1\frac{1}{2}$ inches, as required by block standards, i.e., perhaps about $1\frac{1}{2}$ inches. The insulation material thickness, illustrated at 218, may be perhaps at least about 2 inches. For example, the 12 inch width allows the insulation thickness to be perhaps about 2 inches along the transverse portions thereof and be increased to perhaps about $2\frac{1}{2}$ inches along the longitudinal portions thereof.

The block shown in FIG. 8 has a nominal width, illustrated at 202, of perhaps about 10 inches. The insulation thickness, illustrated at 206, may be perhaps about $1\frac{3}{4}$ inches, and the distance, illustrated at 208, between the insulation material and the longitudinal edges of the block is preferably at least about $1\frac{3}{8}$ inches, as required by block standards, i.e., perhaps about $1\frac{3}{8}$ inches.

Blocks may be mitered to provide corners, or inside and outside corner blocks similar to blocks 12 and 14 in FIG. 1 may be used for corner blocks for 10 and 12-inch width walls so as to provide an 8-inch half corner bond. The corner blocks may alternatively be constructed to have different widths at the end walls to accommodate, for example, a 10 or 12-inch wall width at one end and a required half corner bond width of 8 inches at the other end.

Referring to FIG. 2, with the exception of corner blocks 12 and 14, it is intended that each of the blocks 10 in a wall be substantially identical. It is also intended that the blocks be laid in courses in a staggered half-bond relation, as illustrated in FIG. 2 and previously discussed. In order that the insulation be uniformly disposed throughout the wall without compromising gaps and in order to increase the lateral stability of the structure, in accordance with the present invention the blocks 10 are constructed so as to achieve alignment of the insulating portions 20 and therefore the block parts 16 and 18 when the blocks 10 are stacked in half-bond relation, as visualized in FIG. 2, by bringing the course 22 directly over course 24 with block half 26 aligned with block half 28. Alignment of the insulating portions 20 also allows the rib 102 in a lower block to be received in a groove 104 in an upper block for more effective insulative capability, as illustrated in FIG. 3.

Referring again to FIG. 2, the end walls are preferably provided with recesses 112 which are filled with mortar during laying thereof so as to effectively key the blocks against lateral movement upon hardening of the mortar. Vertical holes 66 may be provided in the blocks 10 not only to provide hand-holds for easier handling of the blocks but also to allow rebars to be inserted vertically therethrough. These vertical holes 66 are provided on the center plane 38 so as to be in alignment with the spacing between the blocks provided by recesses 110 in the end walls 34 and 36 so that rebars may be received vertically through more than one course of blocks stacked in a half-bond relation. Grout may, if desired, be provided within the recesses 110 and holes 66 with the rebars inserted to further key the blocks against lateral movement.

In order to increase the strength of a wall produced with the blocks, diagonal grooves, illustrated at 114, having a depth so that their bottoms are coincident with the upper wall surface, may be provided in the insulation portion 20 along the upper wall surfaces, and Durawall steel mesh reinforcing material or other suitable reinforcement material may be provided in the recesses and correspondingly along the upper surfaces of the block parts.

Referring to FIG. 2, in order to achieve alignment of the insulating portions 20 when the blocks are staggered in a half-bond relation, the portion of the serpentine pattern in one block half 26 is substantially a repeat of the serpentine-pattern portion in the other block half 30, i.e., going from left to right in each of the block halves 26 and 30, the same serpentine pattern is traced. The resulting alignment of the block halves allows enhanced lateral stability so that, when the blocks are bedded properly with the insulation properly engaging, the blocks may be said to present as a veritable two-wythe wall that is dovetailed or interlocked together in a compressed single width. For example, the blocks in FIG. 5 may be said, relative to lateral stability, to be the equivalent of two 5-inch walls within the 8-inch width thereof. In the event of a fire, the block part separation plus the insulation allows one of the block parts 16 or 18 of the blocks 10 to remain relatively cool for increased effectiveness as a fire barrier.

At wall ends such as door or window facings, half blocks are required in alternate courses. In order to maintain the half-bond symmetry, these half blocks should be similar to the block halves 26. In order that these half blocks may have structural integrity, in accordance with the present invention the blocks 10 are constructed so that, if a block were severed along line 38 into two half blocks, each half block would independently have an interlocking connection between the block parts and the insulation. In order to achieve such an interlocking connection for such a half block, one of the block parts 18 has one of the projections 54 centrally of the length thereof and at least one projection in each of the block halves, i.e., projection 52 in block half 26 and projection 56 in the block half 30, and the other block part 16 has at least one projection in each of the block halves, i.e., projection 58 in block half 26 and projection 60 in block half 30. Thus, if a block were split in half along line 38, each of block halves 26 and 30 would provide half blocks with structural integrity maintained for use in alternate courses at wall ends.

The corners defined by the projections are preferably rounded to provide ease of casting in a mold. A mold for each of the block parts 16 and 18 may have a slight taper or perhaps about 1/64 inch per inch for ease of block part removal from the mold. If desired, the insulation material can be similarly tapered to be wedge-shaped to fit snuggly between the block parts, as illustrated in FIG. 7.

The mold for the insulation material 20 may be such that the mold halves may be pulled away for removal therefrom so that it is not required that the insulation material be tapered. Referring to FIGS. 3 and 6, in order to provide a uniform thickness of the insulation portion 20 throughout the height thereof, one of the block parts, such as block part 16, may be inverted so that its taper will be in the same direction as the taper of the other block part so that the inner surfaces 48 and 50 will be parallel to each other.

With the lower end of the insulating portion 20 being accordingly about ⅛ inch offset from the upper end thereof, the ribs 102 and grooves 104 may be positioned therein so as to mate, using principles commonly known to those of ordinary skill in the art to which this invention pertains.

In order to enhance the interlocking relationship between the block parts and the insulation portion, the insulation portion 20 may be suitably bonded to the block parts. Referring to FIGS. 6 and 7, cavities or passages, illustrated at 232, are provided within the insulation material 20, which may be a slip-fit polystyrene insert which may be said to be a quasi-in-place mold. These passages 232 may, for example, be a pair of vertically-spaced passages as shown or may be a series of cavities or may have any other suitable configuration. A polyurethane expanding foam 234 or the like may be injected into the passages 232 via, for example, a needle-type injector, illustrated at 236, in order to cement the block parts and insulation material 20 together to form an essentially integral unit while also providing enhanced energy efficiency. The injector needle is passed through the insulation 20. If desired, the two passages 232, illustrated in FIGS. 6 and 7, may be interconnected so that only one injection is required.

Referring to FIG. 4, in order to enhance the interlocking effect of the block parts and insulating portion for enhanced block integrity, one or more pins 116 are inserted longitudinally into the assembled block 10. Preferably, at least two pins 116 are inserted along different axes thereby providing multi-axis pinning in order to prevent prime movement (the overcoming of stationary inertia) of the block parts relative to each other in the event of degradation of the interlocking insulating material therebetween to thus maintain stationary inertia thereof and thereby provide enhanced block integrity. The pins 116 are preferably inserted along the longitudinal center plane 118 of the block and from opposite end walls 34 and 36 thereof, each pin extending over a distance slightly less than half the block length so as to minimize its effects on conductive heat loss. However, for increased longitudinal stability, the pin length is preferably such that each of the projections is penetrated by a pin. The pins are preferably of small diameter to minimize heat loss. For example, each of the pins for a 16-inch long block may have a diameter of 3/16 inch, have a length, illustrated at 122, of perhaps about 7½-inches, and be galvanized gutter spikes or the like. For heavier duty applications, more than two such pins 116 may be utilized. The pins may suitably be located about 1½ inches below the top wall 44 and about 1½ inches above the bottom wall 46 respectively to optimally enhance resistance to block part rotation while handling.

Referring to FIG. 8, if desired, a bond beam slot, illustrated at 120, may be provided lengthwise of a block in the upper surface 44 and a reinforcing rod inserted therein during wall construction to take the place of one of the pins or, as shown in FIG. 8, may be provided in addition to the pins. For example, the bond beam slot 120 may perhaps be about 1 inch deep along the longitudinal center plane and have therein a preferably ¼ to ⅜-inch reinforcing rod, which may preferably be ridged. If an upper pin is still desired, it may, for example, be placed about 1 inch below the bond beam slot, as illustrated in FIG. 8. If a bond beam slot is provided, the diagonal grooves shown in FIGS. 1, 2 and 5 for insertion of Durawall steel mesh or other reinforcement may be eliminated.

FIG. 5 shows a block without pinning wherein the bulbous end portions 64 are shown to be enlarged and with small radii at the neck ends of the projections. The pinning or bonding of the block parts and insulation together allows the "R" value or thickness of the insulating portion 20 to be maximized within the constraints of the standard block sizes, especially length. Thus, as shown in FIGS. 1 and 2 for pinned blocks, the multiaxial pinning allows the enlarged bulbous end portions 64 of the projections to be reduced in size to perhaps only slightly larger than the neck width. Larger radii may also be provided at the neck end of the projections, and the projections may be slightly shortened to add to their solidarity while increasing the minimum width of the insulating portion 20 by perhaps at least 25 percent. This allows increased insulation width in the curves for a more simple tongue-and-groove configuration, i.e., better tolerances in the curves for less constraint during manufacture.

Referring to FIG. 9, there is shown at 130 a portion of a composite wall in accordance with an alternative embodiment of the present invention. The composite wall 130 comprises an inner portion of a plurality of vertically stacked courses of blocks 132, an outer portion or sheet 134 of poured concrete, and insulating material 136 between the blocks 132 and the concrete sheet 134.

The wall 130 is illustrated in FIG. 9, with parts broken away for clarity of illustration, in the process of being constructed wherein removable forms 138 held in position by thin brackets or wall ties 140 are provided, in accordance with principles commonly known to those of ordinary skill in the art to which this invention pertains, for pouring of the concrete and to define the outer surface 142 of the completed wall.

The blocks 132, which may be similar to block parts 16 in FIGS. 1 to 8, each has a planar sidewall 144, a serpentine-shaped sidewall 146 for facing with the insulation 136, a pair of generally planar parallel end walls 148 and 150, and a pair of generally planar parallel top and bottom walls 152 and 154 respectively.

The sidewall 146, which is serpentine-shaped over the height thereof, defines a pair of projections 156 each having a neck 158 with an enlarged bulbous end portion 160 for forming a secure attachment with the like shaped insulating member 136, similarly as the projections 58 and 60 of the block part 16 are provided.

The insulating portion 136 is formed in a generally uniform thickness serpentine pattern to mate with the sidewall 146. As seen in FIG. 9, the poured concrete 134 forms with the insulating portion 136 a complementary serpentine-shaped pattern with the resulting serpentine-shaped inner surface 161 of the poured concrete sheet 134, which may also be called a slab or panel, defining projections 162 which are alternately disposed between projections 156, either in the same block 132 or between projections 156 of adjacent blocks. These projections 162, like the projections 156, have neck portions 164 ending in enlarged bulbous end portions 166 in order to provide a secure attachment between the cured concrete sheet 134 and the insulating material 136.

In order to provide increased integrity to the wall 130, the insulation portions 136 are formed to extend over a height of more than one course of blocks 132. As illustrated in FIG. 9, each insulating portion 136 (except for the bottom one) extends over the height of perhaps three courses of blocks, which are laid in a half-bond relation. Thus, in order that the serpentine-shaped sidewalls 146 of the blocks in an upper course may be in alignment with the serpentine-shaped sidewalls of the blocks of a lower course so that the insulation portion 136 may extend over the heights of both courses of blocks, the blocks 132 are constructed so that the serpentine pattern of sidewall 146 in the second block half 172 is a repeat of the serpentine pattern of the sidewall in the first block half 170 similarly as the pattern of block half 26 is a repeat of the pattern of block half 30 in the block 10 of FIG. 2. Block halves 170 and 172 are defined by a plane 168 which is midway between the end walls 148 and 150 and parallel thereto. Thus, a second block half 172, being a repeat of the first block half 170, will be in alignment with the first half 170 of a block in the course below, and the first block half in the course below will be in alignment with the second block half of a block in the course below it, etc., thus to provide good lateral stability to the wall.

In order to provide half blocks in alternate courses at wall ends such as door or window facings while maintaining the desired half-bond symmetry with the block halves independently having structural integrity, each of the block halves 170 and 172 has at least one projection 156. In order that the alternating projections 162 may be provided in the poured concrete, at least one of the block projections 156 in each block half is spaced from the respective end wall. Thus, the projections 156 are shown as spaced from the respective end walls 148 and 150 to allow the projections 162 alternately between projections 156. It should be understood that if a block half has more than one projection, one of the projections may extend along the respective end wall to define the end wall.

The wall 130 may also have outside and inside corner blocks, illustrated at 174 and 176 respectively, which may be similar to the respective block parts of blocks 12 and 14. Similarly, blocks 176 may have alignable lightening holes 178 for insertion of reinforcing rods (not shown) as well as to provide hand-holds. Corresponding outside and inside corner insulation panels 192 and 194, similar to respective block insulation portions 74 and 75 in blocks 12 and 14 respectively may also be provided and may extend, as required, beyond a block wall to a point midway of the length of the adjacent block, in accordance with the principles as described hereinafter for the blocks 132.

Bond beam slots, illustrated at 182, may be provided longitudinally in the surfaces of the upper walls 152 intermediate the lengths of the projections 156 for insertion of bond beams 184, which may come in lengths of perhaps about 20 feet, end to end over the entire length or perimeter of the wall. The bond beam slots 182 are also positioned to be intermediate the projections 162 in the completed wall. As shown in FIG. 9, the brackets 140 are secured to the bond beams by engagement of the bond beams in slots, illustrated at 186, in the ends of the brackets 140. For adjustability of the sheet thickness, the brackets 140 may be provided in various lengths. The forms 138 are removed after the concrete 134 has cured, and the wall ties 140 remain permanently within the pour. The wall ties 140 may contain notches 196 to facilitate securing additional reinforcing rods in correct juxtaposition relative to the pour of the concrete sheet. As seen in FIG. 9, bond beams 184 are provided in every third course of blocks, and the insulating portions 136 are sized to vertically extend over the three courses of blocks between each pair of bond beams 184. The number of courses in which the bond beams are provided are minimized in order to maximize insulating effectiveness. The upper edge of each insulation portion 136 is terminated with a rib 198 similar to rib 102 of FIG. 3. The bond beam 184 rests on the ribs as well as in the bond beam slots and is entrapped therein by the next overlying course of blocks. The lower edge of each insulation portion has a complementary shape to engage the rib 198 and is provided with a suitable slot (not shown) or otherwise suitably shaped to clear the bond beam.

If desired, the insulation members 136 may be constructed and fitted together with their upper and lower edge portions notched and in an overlapping arrangement in what might be called a "ship lap" construction with the bond beams resting on shoulders defined by the notched upper edges.

The planar sidewalls 144 define the inner surface of the wall 130. The blocks 132 may be dry stacked with a bonding agent or conventionally laid with mortar. Initially, a single course of blocks 132 may be set and aligned before, for example, 7 inches high by 16-inches long serpentine-shaped insulation panels, illustrated at 188, are installed to just the first course of blocks. One or more, as needed, bond beam rods 184 are then installed in the provided slots 182 in the projections 162 of the blocks 132. The bond beams 184 thus lie along the ribs 198 of the insulating members 188 and as well within the bond beam slots 182. Three more courses of blocks 132 are then set, plumbed, and aligned followed by the installation of insulating panels 136 vertically covering all three courses and another set of bond beam rods 184 are installed. In order to cover three courses of blocks, including mortar therebetween, these insulation panels 136 may perhaps have a height of 24 inches and a length of perhaps 16 inches, equal to the length of a block. For an 8-inch increment, a 16-inch panel may be cut in half and the tongue removed for use. For less than an 8-inch increment, adjustments may be provided in accordance with principles commonly known to those of ordinary skill in the art to which this invention pertains. The thickness of the insulation panels 136 and 188 may perhaps be about 2 inches. Subsequent courses of three or more blocks are similarly laid until the desired wall height is achieved. The wall insulation panels are as a result each entrapped by their serpentine configuration in combination with like configurations of the block projections 156. The bond beams 184 are provided to prevent displacement relative to the longitudinal plane thereof as well as to hold the blocks to the poured concrete sheet. The wall ties 140 are installed on each bond beam adjacent to each joint of wall forms as assembling thereof proceeds in order from one corner to the next until the entire forming is complete. These wall ties hold the forms in juxtaposition. Windows and the like may be installed, utilizing principles commonly known to those of ordinary skill in the art to which this invention pertains, utilizing suitable window forms and half blocks in alternate courses, and additional reinforcing rods may be installed as required.

After the blocks and insulating panels have been suitably laid, the concrete material may then be poured and J-bolts, illustrated at 180, inserted using principles commonly known to those of ordinary skill in the art to which this invention pertains. This concrete material is then allowed to cure thereby providing an interlocking arrangement of the blocks and the concrete sheet 134 for a strong, high quality, insulated wall. The forms 138 may then be removed. The bond beams then function to hold the blocks to the solidarity of the poured concrete sheet and reinforce the wall.

It should be understood that while the present invention has been described in detail herein, the invention can be embodied otherwise without departing from the principles thereof, and such other embodiments are meant to come within the scope of the present invention as defined by the appended claims.

What is claimed is:

1. A building block having two opposite and parallel sidewalls, two opposite and parallel end walls, and parallel top and bottom walls, wherein a plane parallel to the end walls and midway therebetween defines a pair of block halves, the building block comprising two spaced block parts extending along the length of the block sidewalls, said block parts having facing spaced inner surfaces which are configured to define projections alternately of said block parts over the length of the block which overlap each other to thereby define a space between said block parts which, in a section parallel to the top and bottom walls, is in the shape of a serpentine pattern over the length of the block, an insulation portion positioned within and substantially filling the space between said block parts, said projections having enlarged end portions for interlocking said insulation portion to said block parts, the block further characterized by the portion of the serpentine pattern in one of the block halves being substantially a repeat of the portion of the serpentine pattern in the other of the block halves such that two of the block are stackable in a staggered half-bond relation with alignment between the serpentine-pattern portions in the stacked block halves, one of said block parts having one of said projections centrally of the length thereof and at least one of said projections in each of said block halves, and the other of said block parts having at least one of said projections in each of said block halves.

2. A building block according to claim 1 further comprising means including a rib on an edge of said insulation portion and a mating groove on an opposite edge of said insulation portion for matingly connecting said insulation portion to like insulation portions of adjacent blocks.

3. A building block according to claim 2 wherein said insulation portion has a lower edge in which said groove is contained and which is flush with said bottom wall and an upper edge in which said rib is contained and which extends outwardly from said top wall.

4. A building block according to claim 1 wherein said block parts each have inner surfaces which engage said insulation portion and which are tapered, said block parts disposed relative to each other so that said inner surfaces are generally parallel.

5. A building block according to claim 1 wherein said one block part has two of said projections which define partially said end walls respectively, and said central projection has a width equal substantially to the combined width of said end wall defining projections whereby to overlie in alignment with an end wall defining projection on one block and an adjacent end wall defining projection on an adjacent block.

6. A building block according to claim 5 further comprising means defining a recess vertically over the height of each of said end walls which, when said recess is adjacent a like recess in an adjacent block, defines a rebar receiving cavity between the adjacent blocks, and means defining a vertical cavity through said central projection and midway between said end walls whereby said cavity through said central projection is alignable with a rebar receiving cavity in each of a pair of adjacent like blocks for receiving rebar when in a half-bond relation.

7. A building block having two opposite and parallel sidewalls, two opposite and parallel end walls, and parallel top and bottom walls, the building block comprising two spaced block parts extending along the length of the block sidewalls, said block parts having facing spaced inner surfaces which are configured to define projections alternately of said block parts over the length of the block which overlap each other to thereby define a space between said block parts, which, in a section parallel to the top and bottom walls, is in the shape of a serpentine pattern over the length of the block, an insulation portion positioned within and substantially filling the space between said block parts, and means for interlocking said insulation portion to said block parts, said interlocking means comprising at least two aperture means having different axes for receiving pins, each of said aperture means extending longitudinally of the block through at least one of said projections of one of said block parts and at least one of said projections of the other of said block parts, the block having a pair of block halves defined by a plane parallel to the end walls and midway therebetween, the block further characterized by the portion of the serpentine pattern in one of the block halves being substantially a repeat of the portion of the serpentine pattern in the other of the block halves such that two of the block are stackable in a staggered half-bond relation with alignment between the serpentine pattern portions in the stacked halves.

8. A building block according to claim 7 wherein said interlocking means further comprises an enlarged end portion on at least one of said projections.

9. A building block according to claim 7 wherein each of said block halves has at least two of said projections.

10. A building block according to claim 7 wherein said aperture means together extend at least partially through each of all of said projections of the block.

11. A building block according to claim 7 further comprising at least two pins received in said aperture means respectively, at least one of said pins extending into the block from each of said end walls respectively.

12. A building block according to claim 11 wherein said pins together extend at least partially into each of all of said projections of the block so that all of the projections are engaged by a pin, each of said pins having a length which is less than half of the length of the block.

13. A building block according to claim 7 further comprising means defining a bond beam slot in said top wall.

14. A building block according to claim 7 further comprising at least one cavity means within said insulation portion and a material within said cavity means bonding said insulation portion to at least one of said block parts.

15. A building block having a pair of opposite and parallel end walls, a top wall, a bottom wall parallel to said top wall, a first planar sidewall, and a second sidewall opposite said first sidewall, said second sidewall being configured to define at least two projections such that said second sidewall is shaped, as viewed in a plane parallel to said top and bottom walls, to define a serpentine pattern over the length of the block, said projections having enlarged end portions for interlockingly receiving insulation material having said serpentine pattern adjacent said second sidewall, a plane midway between and parallel to said end walls defining two block halves, each said block half having at least one of said projections which is spaced from said respective end wall, and said block further characterized by the portion of the serpentine pattern in one of said block halves being substantially a repeat of the portion of the serpentine pattern in the other of said block halves whereby two of the block are stackable in a staggered half-bond relation with alignment between the serpentine-pattern portions in the respectively stacked block halves.

16. A method for constructing a building block comprising the steps of:

a. assembling a pair of block parts with an insulation member therebetween having at least one cavity therein such that the cavity is enclosed by the insulation member and block parts;

b. injecting a bonding material into the cavity in contact with the insulation member and at least one of the block parts;

c. curing the bonding material; and d. selecting the insulation member and block parts such that the inner surfaces of the block parts are configured to define projections alternately of the block parts over the length of the block which overlap each other to thereby define a space between the block parts which, in a section parallel to the top and bottom walls of the blocks, is in the shape of a sepentine pattern over the length of the block and such that the insulation member also has a serpentine pattern to substantially fill the space between the block parts and such that the portion of the serpentine pattern in one block half, defined by a plane parallel to the end walls of the block and midway therebetween, is substantially a repeat of the portion of the serpentine pattern in the other of the block halves such that two of the blocks are stackable in a staggered half-bond relation with alignment between the serpentine-patterned portions in the stacked block halves.

17. A method according to claim 16 comprising injecting the bonding material into the cavity in contact with the insulation member and both of the block parts.

18. A composite wall comprising a plurality of courses of blocks, each block having a pair of opposite and parallel end walls, a top wall, a bottom wall parallel to said top wall, a first planar sidewall defining a first composite wall surface, and a second sidewall opposite said first sidewall, said second sidewall being configured to define at least two projections such that said second sidewall is shaped, as viewed in a plane parallel to said top and bottom walls, to define a serpentine pattern over the length of the block, a plane midway between and parallel to said end walls defining two block halves, said block further characterized by the portion of the serpentine pattern in one of said block halves being substantially a repeat of the portion of the serpentine pattern in the other of said block halves, said blocks being stacked in a staggered half-bond relation with alignment between the serpentine-pattern portions in the respectively stacked block halves, a poured concrete sheet having a first sidewall which defines a second composite wall surface and a second sidewall which faces said courses of blocks and which is shaped to define a serpentine pattern similar to the serpentine patterns of said blocks such that a generally uniform thickness space is defined between said sheet and said courses of blocks, insulation material positioned within and substantially filling the space between said poured concrete sheet and said courses of blocks, and means for interlocking said insulation material to said blocks and said poured concrete sheet.

19. A composite wall according to claim 18 wherein said insulation material comprises a plurality of insulation portions each extending over the height of at least two of said blocks.

20. A composite wall according to claim 18 further comprising a plurality of reinforcing members each passing lengthwise of a plurality of said blocks through the sheet and slot means in the blocks.

21. A composite wall according to claim 18 wherein said interlocking means comprises enlarged end portions on said block projections and projections on said concrete sheet which alternate with and overlap said block projections and which have enlarged end portions.

22. A building block having two opposite and parallel sidewalls, two opposite and parallel end walls, and parallel top and bottom walls, the building block comprising two spaced block parts extending along the length of the block sidewalls, said block parts having facing spaced inner surfaces which are configured to define projections alternately of said block parts over the length of the block which overlap each other to thereby define a space between said block parts, an insulation portion positioned within and substantially filling the space between said block parts, and means for interlocking said insulation portion to said block parts, said interlocking means comprising at least two pins each of which is inserted in one of said end walls and extends longitudinally of the block through at least one of said projections of one of said block parts and at least one of said projections of the other of said block parts, said pins having axes which are spaced apart.

23. A building block according to claim 22 wherein said interlocking means further comprises an enlarged end portion on at least one of said projections.

24. A building block according to claim 22 wherein a plane parallel to the end walls and midway therebetween defines a pair of block halves, each of said block halves having at least two of said projections.

25. A building block according to claim 22 wherein said pins together extend at least partially through each of all of said projections of the block.

26. A building block according to claim 22 wherein at least one of said pins extends into the block from each of said end walls respectively.

27. A building block according to claim 26 wherein said pins together extend at least partially into each of all of said projections of the block so that all of the projections are engaged by a pin, each of said pins having a length which is less than half of the length of the block.

* * * * *